US006801729B2

(12) United States Patent
Wada et al.

(10) Patent No.: US 6,801,729 B2
(45) Date of Patent: Oct. 5, 2004

(54) IMAGING APPARATUS WITH IMAGE FIXING THROUGHPUT CONTROL BASED ON SHEET SIZE AND METHOD OF OPERATION THEREOF

(75) Inventors: Atsushi Wada, Shizuoka (JP); Takashi Nakahara, Shizuoka (JP); Koichi Otaka, Shizuoka (JP); Yuichi Seki, Saitama (JP); Hiroshi Takazawa, Chiba (JP); Takashi Sekiguchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 33 days.

(21) Appl. No.: 10/183,568

(22) Filed: Jun. 28, 2002

(65) Prior Publication Data

US 2003/0016958 A1 Jan. 23, 2003

(30) Foreign Application Priority Data

Jul. 3, 2001 (JP) ..... 2001-201999

(51) Int. Cl.[7] ..... G03G 15/00; G03G 15/20

(52) U.S. Cl. ..... 399/68; 399/45; 399/69

(58) Field of Search ..... 399/45, 67, 68, 399/69, 328

(56) References Cited

U.S. PATENT DOCUMENTS 5,289,247 A * 2/1994 Takano et al. ..... 399/68
5,436,709 A * 7/1995 Sakaizawa et al. ..... 399/69
5,552,874 A * 9/1996 Ohtsuka et al. ..... 399/69
5,669,039 A * 9/1997 Ohtsuka et al. ..... 399/68
5,747,774 A 5/1998 Suzuki et al. ..... 219/216
5,874,710 A 2/1999 Yoshimoto et al. ..... 219/216
6,115,563 A * 9/2000 Miyamoto ..... 399/67
6,151,462 A * 11/2000 Fukuzawa et al. ..... 399/67
6,177,977 B1 1/2001 Tanaka et al. ..... 355/26
6,185,381 B1 2/2001 Nakahara et al. ..... 399/21
6,397,021 B2 * 5/2002 Hayashi et al. ..... 399/69
6,466,751 B1 * 10/2002 Kawano ..... 399/68
6,526,251 B1 2/2003 Otsuka et al. ..... 399/313
6,580,883 B2 * 6/2003 Suzumi ..... 399/69

* cited by examiner

*Primary Examiner*—Fred Braun
(74) *Attorney, Agent, or Firm*—Fitzpatrick, Cella, Harper & Scinto

(57) ABSTRACT

An image forming apparatus has an image forming unit and a film-heat-type fuser over which a sheet with an unfixed toner image passes and on which are positioned a first temperature-measuring device centered on the fuser so that a sheet always passes over that device and a second temperature measuring device disposed away from the center so that large sheets will pass over the second temperature measuring device and small sheets will not pass over the device when being conveyed correctly. The device also has a temperature control mechanism, a sheet size detector and throughput control, so that the throughput control changes throughput when the sheet size detector determines that a small sheet is being conveyed and the difference between the temperatures of the first and second temperature measuring devices is less than a predetermined value as the sheet passes over the fuser.

20 Claims, 7 Drawing Sheets

IMAGING APPARATUS WITH IMAGE FIXING THROUGHPUT CONTROL BASED ON SHEET SIZE AND METHOD OF OPERATION THEREOF

BACKGROUND OF THE INVENTION

1. Field of the Invention

The present invention relates to imaging apparatuses such as laser beam printers. In particular, the present invention relates to a fixing operation of such an imaging apparatus.

2. Description of the Related Art

Hitherto, in a thermal image-fixing device which is included in an imaging apparatus using a recording method such as an electrophotographic method or an electrostatic recording method, a so-called heat-roller-type heat-fuser has been widely used. In such a device, a toner image is fixed to a sheet as a permanent image when the sheet, which carries the toner image, travels through a pressure-nip region formed between a fusion roller and a pressure roller which rotate while being pressed to each other.

A heat-fuser in which electrical consumption is minimized by suspending electric supply during a standby mode is also known. The heat-fuser uses a film-heat method for thermally fixing toner images on sheets by transferring the sheets between a pressure roller and a heating element (a heater) mounted to a supporting unit via a thin film (a fusing film).

The two types of heat-fusers described above, which form thermal image-fixing devices, each include at least one fusion-temperature-measuring member for use in controlling temperature at which images are thermally fixed. The fusion-temperature-measuring member generally uses a thermistor. The fusion-temperature-measuring member is disposed in contact with the heater or the pressure roller and thereby measures the temperature of the heater or the pressure roller. Recently, a method for measuring the temperature for thermal fusion by measuring radiant heat from the heater or the pressure roller has also been studied.

FIGS. 5A, 5B, 5C, and 5D show the relationship of positions between a ceramic heater 11*a* serving as a heater element, thermistors 11*d* and 11*e*, and a sheet 501 or 502. The sheets 501 and 502 are transferred along arrows shown in the drawings. The dimension perpendicular to the transfer direction of each sheet is hereinafter referred to as the width. In FIG. 5A, a sheet having a maximum width that can be transferred in the image forming apparatus is sandwiched between the ceramic heater 11*a* and the pressure roller. In FIG. 5B, a sheet having a minimum width that can be transferred in the image forming apparatus is sandwiched by the ceramic heater 11*a* and the pressure roller. The ceramic heater 11*a* is fixed to a stay 11*b* which positions the ceramic heater 11*a*, as shown in FIG. 6.

The ceramic heater 11*a* opposes a pressure roller 10 with a fusing film 11*c* therebetween. When the pressure roller 10 is driven, a sheet which is sandwiched at a position (hereinafter referred to as a nip) at which the pressure roller 10 and the fusing film 11*c* are in contact with each other is conveyed. During this operation, a developer carried on the sheet is fixed onto the sheet as a result of the pressure from the pressure roller 10 and the heat supplied by the ceramic heater 11*a*. The main thermistor 11*d* is disposed in a position where a sheet passes, regardless of size. That is, the main thermistor 11*d* is disposed in a given position in a region 510 shown in FIG. 5B. The sub-thermistor 11*e* is disposed in a position where a part of a sheet having a maximum width which can be conveyed passes by and which a part of a sheet having a minimum width which can be conveyed does not pass by in a normal state. That is, the sub-thermistor 11*e* is disposed in a given position in region 511 shown in FIG. 5B.

FIG. 5C shows an example of temperature distribution in the ceramic heater 11*a* when the sheet having a minimum width is transferred. During the transfer of the sheet having a minimum width, gaps between the ceramic heater 11*a* and the pressure roller 10 are produced immediately outside the sheet because of the thickness of the sheet, and regions in which heat generated by the ceramic heater 11*a* is not transferred either to the sheet or to the pressure roller 10 are thereby produced. Therefore, the temperature in regions A and B of the ceramic heater 11*a* is increased as shown in FIG. 5C, when the temperature is set to a target temperature by using the main thermistor 11*d*.

The temperature is particularly rapidly increased when a substance having a small width and a large thickness, for example, an envelope is conveyed. For example, when the target temperature is set to 200° C., the temperature in the regions A and B is likely to increase to 300° C.

When the temperature in end portions of the ceramic heater 11*a* is thus increased, the temperature is likely to exceed upper limits of the resistance to heat of the pressure roller 10 and the stay (the heater-supporting member) 11*b*. Therefore, there is a risk of damaging these components. When a plain paper having a large width is printed and the temperature in the end portions of the ceramic heater 11*a* is increased, there is a risk of a hot offset or the like due to an excessively raised temperature.

In order to prevent the temperature of the end portions from increasing when a sheet having a small width is transferred, the throughput is reduced when the temperature measured by the sub-thermistor 11*e* is increased, thereby suppressing the temperature rise in the end portions where no sheet portion passes. The sub-thermistor 11*e* is provided in addition to the main thermistor 11*d* in a position which no sheet portions pass by.

The temperature in the end portions increases at every fusion. Therefore, when the throughput is reduced, the temperature rise in the end portions decreases per unit time, and the components are thereby protected from being damaged.

However, if a user does not correctly set a side-restricting tray when setting envelopes or the like onto a multi-sheet-supply tray, the following problem will occur.

An imaging apparatus, in which a recording sheet having a width smaller than that of a sheet having a maximum width capable of being used in the apparatus is set in a widthwise-intermediate part of a sheet-supply tray (hereinafter referred to as a center-sheet-supply system), uses a side-restricting tray having two side-restricting members provided on the sheet-supply tray when envelopes or the like are supplied. The two side-restricting members are disposed symmetrical with respect to an intermediate part of the side-restricting tray and are movable in conjunction with each other. When a sheet is restricted at both sides thereof, the sheet is positioned at the widthwise-intermediate part (see FIG. 5B).

However, when envelopes or the like are offset toward one side of the sheet-supply tray as a result of the two side-restricting members being away from each other farther than the width of the envelopes or the like, the envelopes or the like are transferred along the regions at which the main thermistor 11*d* and the sub-thermistor 11*e* are provided, as shown in FIG. 5D, and no difference in temperature between the main thermistor 11*d* and the sub-thermistor 11*e* is detected. Consequently, the throughput will not be reduced; as a result, the temperature at positions where no parts of the envelopes or the like pass will increase, and there is a risk of damage to the components such as the pressure roller 10 and the stay 11*b* because the temperature is likely to exceed upper limits of the resistance to heat of these components.

When printing of a plain paper having a larger width is performed when the temperature in the end portions is increased, there is a risk of a hot offset or the like due to an excessively raised temperature.

SUMMARY OF THE INVENTION

Accordingly, it is an object of the present invention to provide an image forming apparatus and a method of operating the image forming apparatus, in which a fuser is protected from being damaged even when a user incorrectly sets a side-restricting tray and sheets, such as envelopes, having a small width and a large thickness.

To these ends, according to an aspect of the present invention, an imaging apparatus comprises a film-heat-type fuser over which a sheet with an image passes for fixing; a first temperature-measuring device for measuring temperature, disposed at a position on the fuser over which part of a sheet regardless of the size of the sheet will pass; a second temperature-measuring device for measuring temperature, disposed at a position on the fuser over which a part of a sheet having a maximum size will pass and over which a sheet having a smaller size will not pass when the sheet of smaller size is conveyed correctly; a temperature-control member for controlling the temperature of the fuser in accordance with the temperature measured by the first temperature-measuring device; a sheet-size-detector for determining the size of the sheet; and a throughput-control for controlling the throughput of the imaging apparatus. The throughput-control changes the throughput when the sheet-size-detector determines that the sheet has the smaller size and when the difference between the temperature measured by the first temperature-measuring device and the temperature measured by the second temperature-measuring device is less than or equal to a predetermined value. The measurement is performed as the sheet passes over the fuser for fixing.

The throughput-control may reduce the throughput when the sheet-size-detector determines that the sheet is the smaller size and when the difference between an average value of the temperature measured in a predetermined period by the first temperature-measuring device and another average value of the temperature measured in the predetermined period by the second temperature-measuring device is less than or equal to a predetermined value, the measurement being performed as the sheet passes over the fuser for fixing.

An imaging apparatus according to an aspect of the invention, wherein the throughput-control reduces the throughput when the sheet-size-detector determines that the sheet is the smaller size and when the difference between an average value of the temperature measured in a predetermined period by the first temperature-measuring device and another average value of the temperature measured in the predetermined period by the second temperature-measuring device is less than or equal to a predetermined value, the measurement being performed as the sheet passes over the fuser for fixing.

The throughput-control may suspend heating and transfer of the sheet when the sheet-size-detector determines that the sheet is the smaller size and when the difference between the temperature measured by the first temperature-measuring device and the temperature measured by the second temperature-measuring device is less than or equal to a predetermined value, the measurement being performed as the sheet passes over the fuser for fixing.

The throughput may be changed when the sheet-size-detector determines that the sheet is the smaller size and when the difference between the temperature measured by the first temperature-measuring device and the temperature measured by the second temperature-measuring device is less than or equal to a predetermined value for a predetermined number of sheets, the measurement being performed as each sheet passes over the fuser for fixing.

According to another aspect of the present invention, a method for operating an imaging apparatus provided with a film-heat-type fuser comprises the steps of determining whether a transferred sheet is smaller than a predetermined value; determining whether a side-restricting tray is set incorrectly for the sheet having a size smaller than the predetermined value; and changing throughput of the imaging apparatus when it is determined that the sheet has a size smaller than the predetermined value and when it is determined that the side-restricting tray is set incorrectly for the sheet having a size smaller than the predetermined value.

The smaller size of the sheet may comprise the size of an envelope.

The side-restricting tray may regulate the position of the sheet to be set thereon with respect to a widthwise-intermediate part of the side-restricting tray.

According to the present invention, an image forming apparatus, in which a fuser is protected from being damaged even when a user incorrectly sets a side-restricting tray and sheets, such as envelopes, having a small width and a large thickness, is obtainable.

Further objects, features and advantages of the present invention will become apparent from the following description of the preferred embodiments with reference to the attached drawings.

DESCRIPTION OF THE PREFERRED EMBODIMENTS

Preferred embodiments of an imaging apparatus according to the present invention are described below in detail. The present invention is applicable not only to the imaging apparatus but also to a method for operating the imaging apparatus according to the embodiments.

First Embodiment (Overall Configuration)

Figure 3:
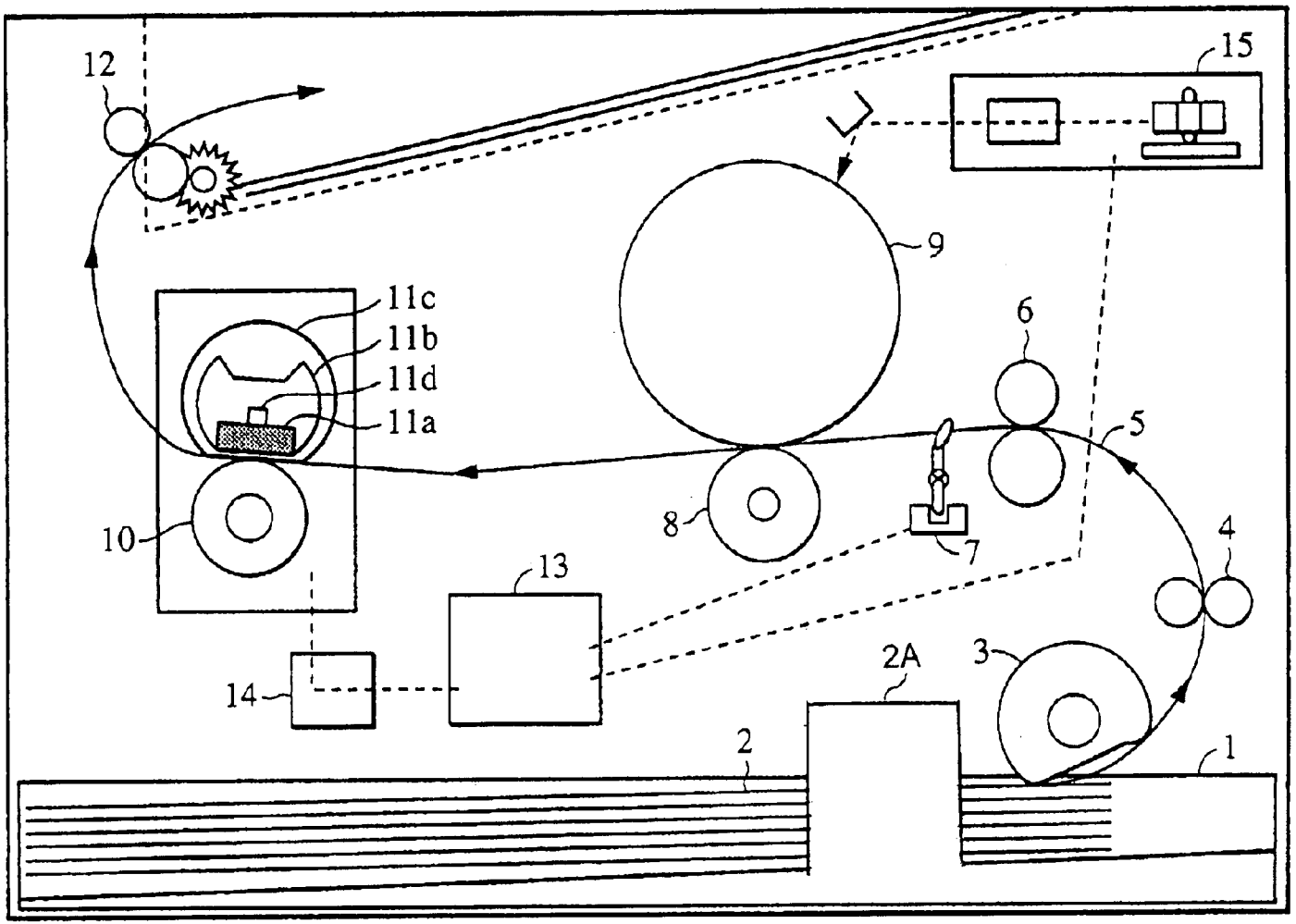
FIG. 3 is an illustration of the outline of the imaging apparatus.

FIG. 3 is an illustration showing is outline form the configuration of an imaging apparatus. In FIG. 3, each sheet 2 stacked in a sheet-supply cassette 1 is taken out by a cassette-sheet-supply roller 3, and is conveyed into a sheet-transfer path 5 by transfer rollers 4. Imaging timing for the sheet 2 is determined and the positions of the leading edge and the trailing edge of the sheet 2 are detected by a sheet sensor 7. The leading edge of the sheet 2 is aligned to the sheet sensor 7 by registration rollers 6. The registration rollers 6 transfer the sheet 2 to a transfer roller 8 and a photosensitive drum 9. The sheet 2 with toner thereon transferred by the transfer roller 8 and the photosensitive drum 9 is conveyed to a pressure roller 10, a fusing film 11*c*, and a ceramic heater 11*a*, which serve to fix the toner to the sheet 2, and the toner is pressure-fixed to the sheet 2. Then, the sheet 2 is discharged by sheet-discharge rollers 12 driven by a motor (not shown). A CPU 13 controls a heater-driving circuit 14 and thereby controls the temperature of the ceramic heater 11*a*.

(Configuration of Fuser)

Figure 4:
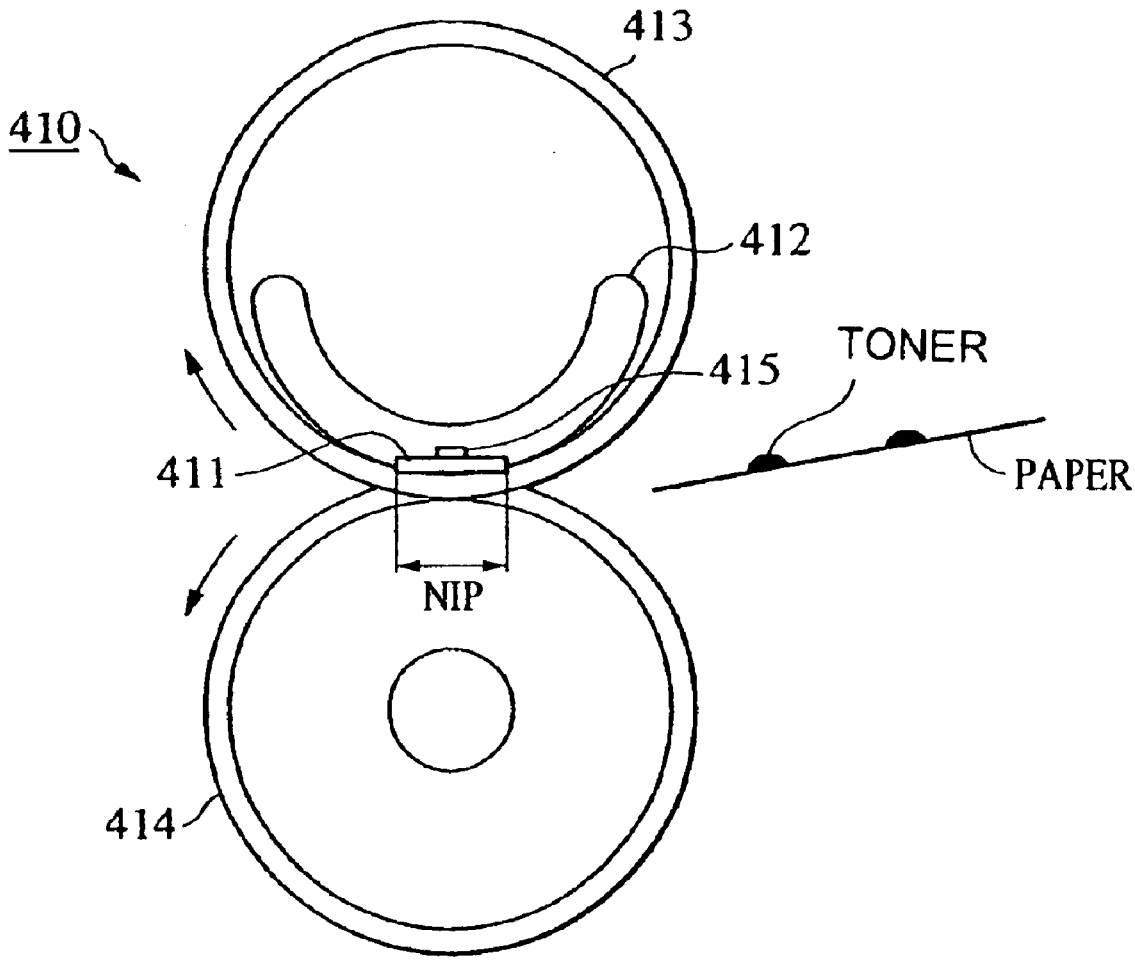
FIG. 4 is an illustration of a film-heat-type fuser.
Figure 5A:
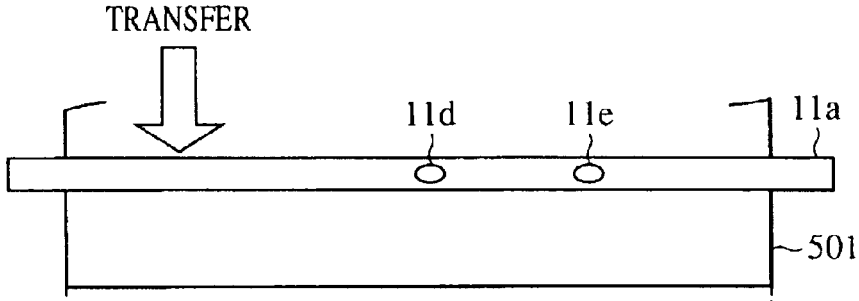
FIGS. 5A, 5B, 5C, and 5D are illustrations showing the relationship of positions between a ceramic heater, thermistors, and a sheet.
Figure 5B:
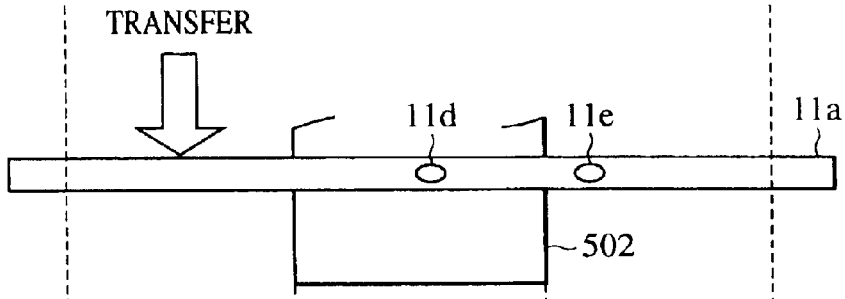
Figure 5C:
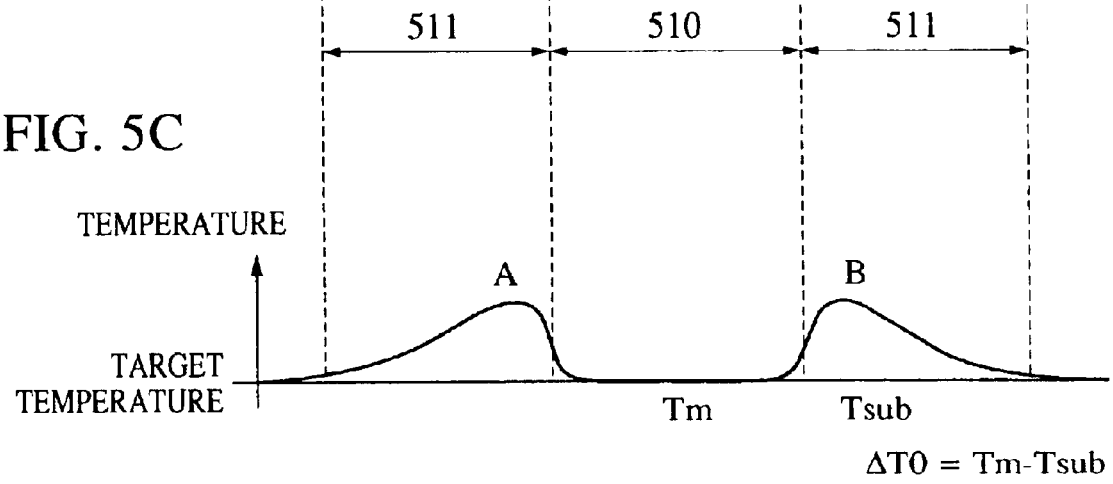
Figure 5D:
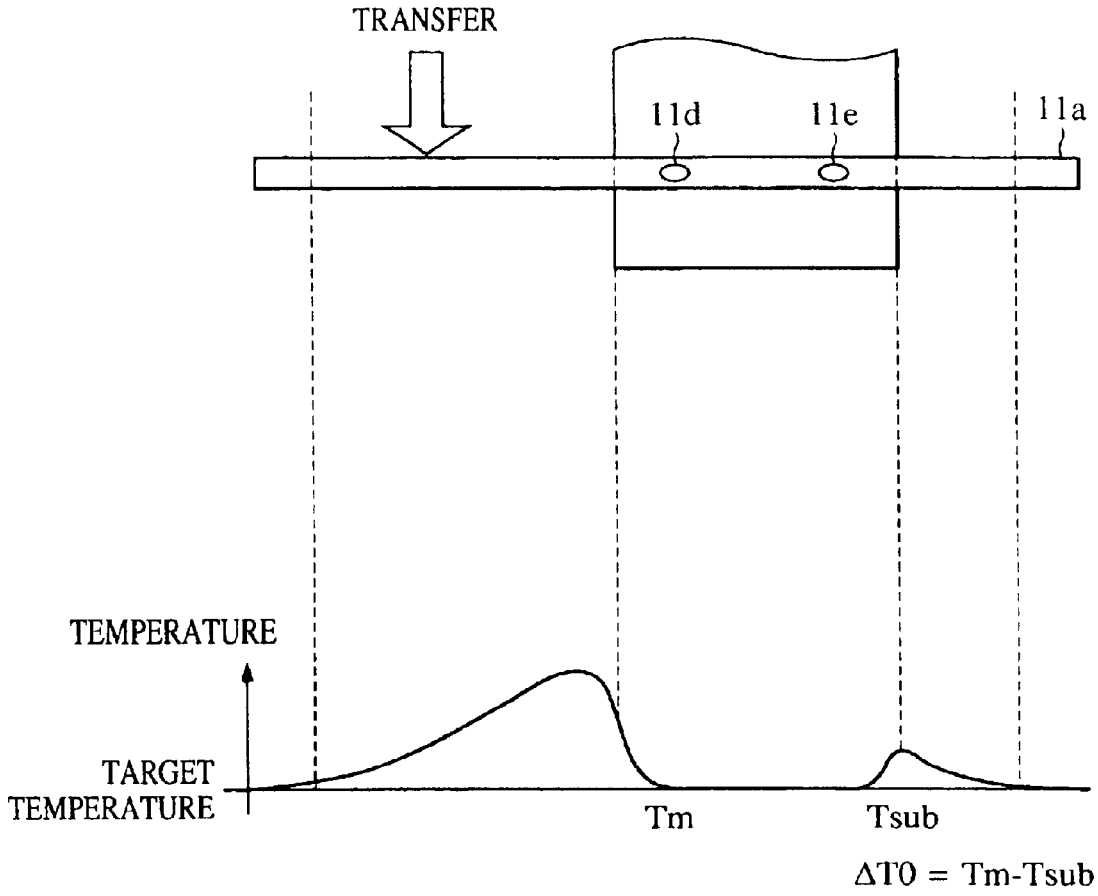
Figure 6:
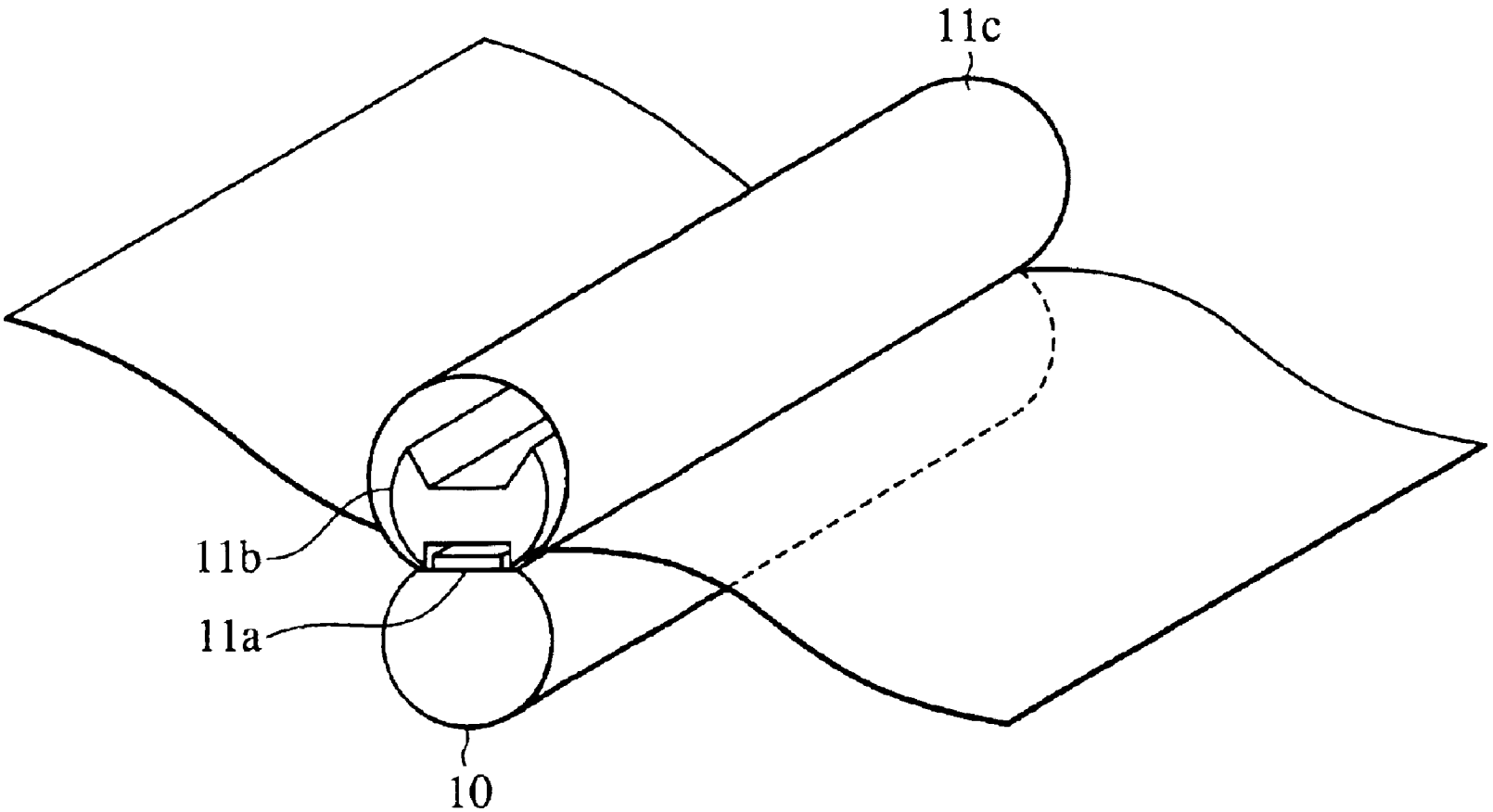
FIG. 6 is an illustration of another film-heat-type fuser.

FIG. 4, is a cross-sectional view of a typical film-heat-type heat-fuser. In FIG. 4, a heating unit 410 includes, as major components, a heater 411, a guide member 412 which is commonly used as a heater-supporting member, and a fusing film 413. The heater 411 is fixed to the guide member 412 which guides the rotational motion of the fusing film 413. The guide member 412 is made of, for example, a heat-resistive resin, supports the heater 411 as a heating element, and guides the fusing film 413. A heat-resistive grease or the like is applied between the fusing film 413, and the heater 411 and the guide member 412 at the periphery thereof so that the fusing film 413 can rotate by sliding smoothly. A thermistor 415 as a fusion-temperature-measuring member for measuring temperature of the heater 411 is generally provided. The thermistor 415 may be mounted to the heater 411 via a heat-resistive adhesive or by pressing by using the pressure of a resilient member. A fuser such as shown in each of FIGS. 5A to 5D and FIG. 6 may be used.

(Normal Operation)

In FIG. 3, each sheet 2 stacked in the sheet-supply cassette 1 is supplied by the cassette-sheet-supply roller 3 and is conveyed by the transfer rollers 4 into the sheet-transfer path 5 in the imaging apparatus. Imaging timing is determined and the leading edge and the trailing edge of the sheet 2 are detected by the sheet sensor 7. The sheets 2 to be supplied are positioned by using a side-restricting tray 2A which restricts sides of each sheet 2 with respect to a widthwise-intermediate part of the side-restricting tray. Therefore, sheets having a small width are also positioned at an intermediate part in the width direction of the side-restricting tray.

Each sheet 2 is aligned at the leading edge thereof to the sheet sensor 7 and is conveyed to the transfer roller 8 and the photosensitive drum 9 at a given timing by the registration rollers 6. The sheet 2 is conveyed with toner thereon by the transfer roller 8 and the photosensitive drum 9 and is conveyed to the pressure roller 10, the fusing film 11*c*, and the ceramic heater 11*a*, which serve to fix the toner to the sheet 2, and the toner is pressure-fixed to the sheet 2. Then, the sheet 2 is discharged by the sheet-discharge roller 12. When pressure-fixing the toner image on the sheet 2, the temperature of the ceramic heater 11*a* is measured by a main thermistor 11*d* and the measured data is sent to the CPU 13. The CPU 13 controls electric power supplied to the ceramic heater 11*a* by using the heater-driving circuit 14 so that the temperature measured by the main thermistor 11*d* becomes a predetermined constant temperature.

The CPU 13 maintains the temperature of the ceramic heater 11*a* constant by controlling the electric power to be applied to the ceramic heater 11*a* such that it increases by the amount of heat which is transferred to the sheet 2 when the sheet 2 passes by the ceramic heater 11*a*. In this case, when a sheet having a smaller width passes by the ceramic heater 11*a*, the temperature of the ceramic heater 11*a* is increased at the end portions thereof where no sheet portion passes.

When the temperature in the end portions of the ceramic heater 11*a* excessively rises, the temperature of the ceramic heater 11*a* and the components such as the fusing film 11*c*, the pressure roller 10, and a stay (heater-supporting member) 11*b* which are in contact with the ceramic heater 11*a* rises excessively. Therefore, these components may deform and deteriorate by being melted, and become incapable of normal function.

(Operational Features)

Figure 1:
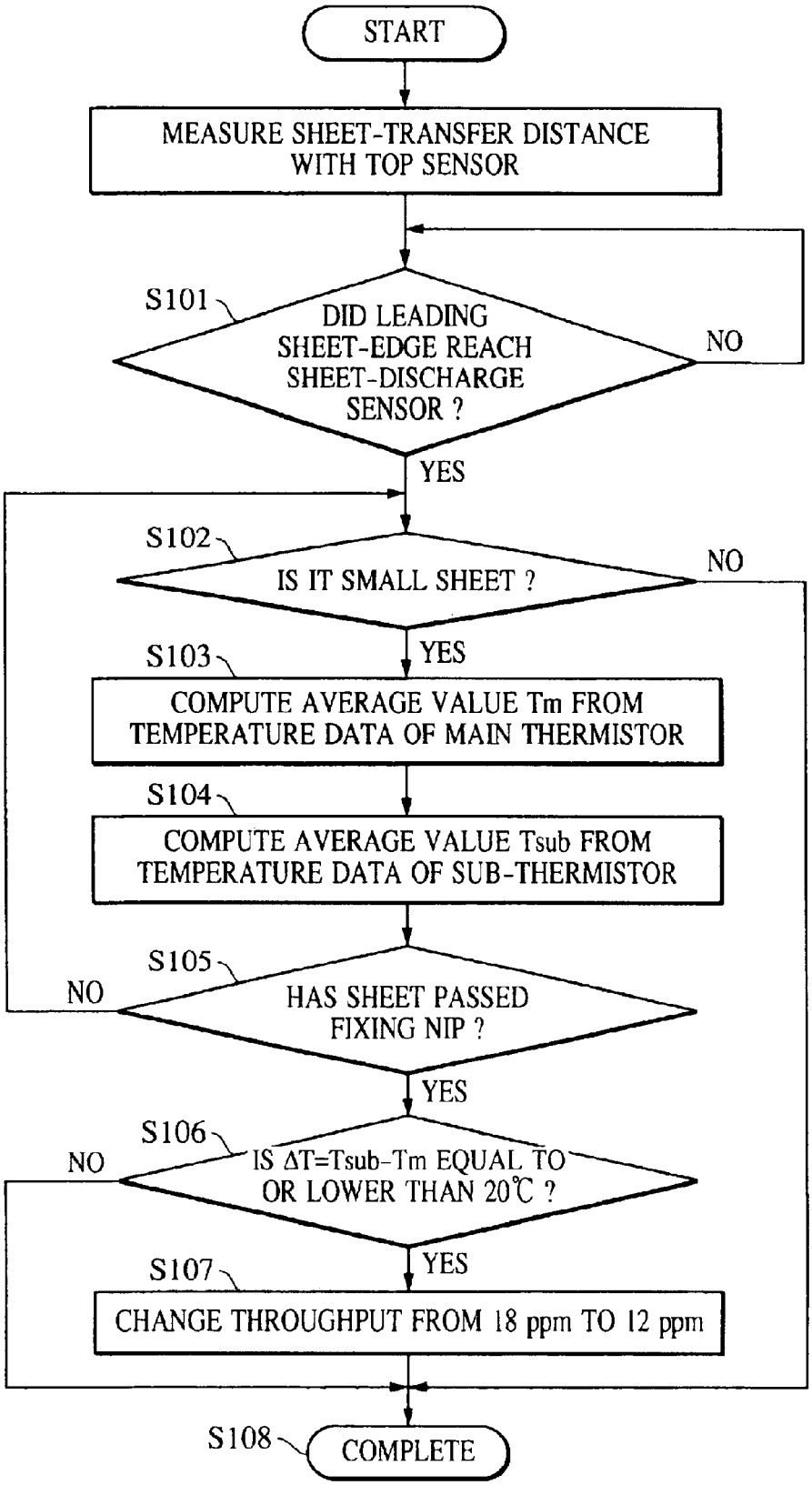
FIG. 1 is a flowchart of an operation of an imaging apparatus according to a first embodiment of the present invention.

FIG. 1 is a flowchart of an operation of the imaging apparatus according to a first embodiment of the present invention.

A sub-thermistor 11*e* is disposed in an end portion of the ceramic heater 11*a* and sends temperature data measured by the sub-thermistor 11*e* to the CPU 13. The CPU 13 determines whether a sheet has a small size such as an envelope and is not a regular-size sheet such as an A4-size sheet or a letter-size sheet (step 102 which is referred to as S102 in the drawing (other reference numerals for steps are referred to in the same manner as step 102)), after the sheet reaches a fixing nip (step 101) in a predetermined time after the leading edge of the sheet is detected by the sheet sensor 7. When it is determined that the sheet has a small size, the average value of the temperature measured by the main thermistor 11*d* and the average value of the temperature measured by the sub-thermistor 11*e* are computed (steps 103 and 104, respectively). The CPU 13 monitors the operations in the above steps until the sheet has passed the fixing nip (step 105). When the difference between the two average values of temperature ($\Delta T = Tsub - Tm$) is less than or equal to 20° C. (step 106), it is determined that a small sheet such as an envelope was supplied without being correctly set by using a side-restricting tray, and the throughput is changed from 18 ppm (the number of sheets to be printed per minute) which is a throughput of printing regular-size sheets to 12 ppm which is a throughput of printing small sheets such as envelopes (step 107).

With this arrangement, the fuser can be protected from being damaged because the temperature in the end portions is kept from rising by appropriately reducing throughput, even when a thick sheet having a small width passes both by the main thermistor 11*d* and by the sub-thermistor 11*e* and the temperature in the end portion opposite to that provided with the sub-thermistor 11*e* rises, in such a case as the thick sheet having a small width such as an envelope is incorrectly set onto the side-restricting tray.

When it is determined in step 102 that the sheet is not a small sheet, the process proceeds to step 108 and is completed.

The side-restricting tray is considered to have been correctly set when it is determined in step 106 that the difference of temperature exceeds 20° C., and the process proceeds to step 108 and is completed.

The throughput may be reduced in step 107 after it is determined by a sensor that a predetermined number of sheets has reached the ceramic heater 11*a*. Instead of reducing the throughput, processes, such as suspending heating and transfer of the sheets and issuing a suggestion or warning to correctly set the side-restricting tray, may be applied.

Second Embodiment

The overall configuration of an imaging apparatus according to a second embodiment of the present invention is similar to that shown in FIG. 3. The configuration of a fuser used in the imaging apparatus according to the second embodiment is similar to that shown in FIGS. 4, 5A, 5B, 5C, 5D, and 6. Therefore, a description regarding these drawings for the second embodiment is omitted.

Figure 2:
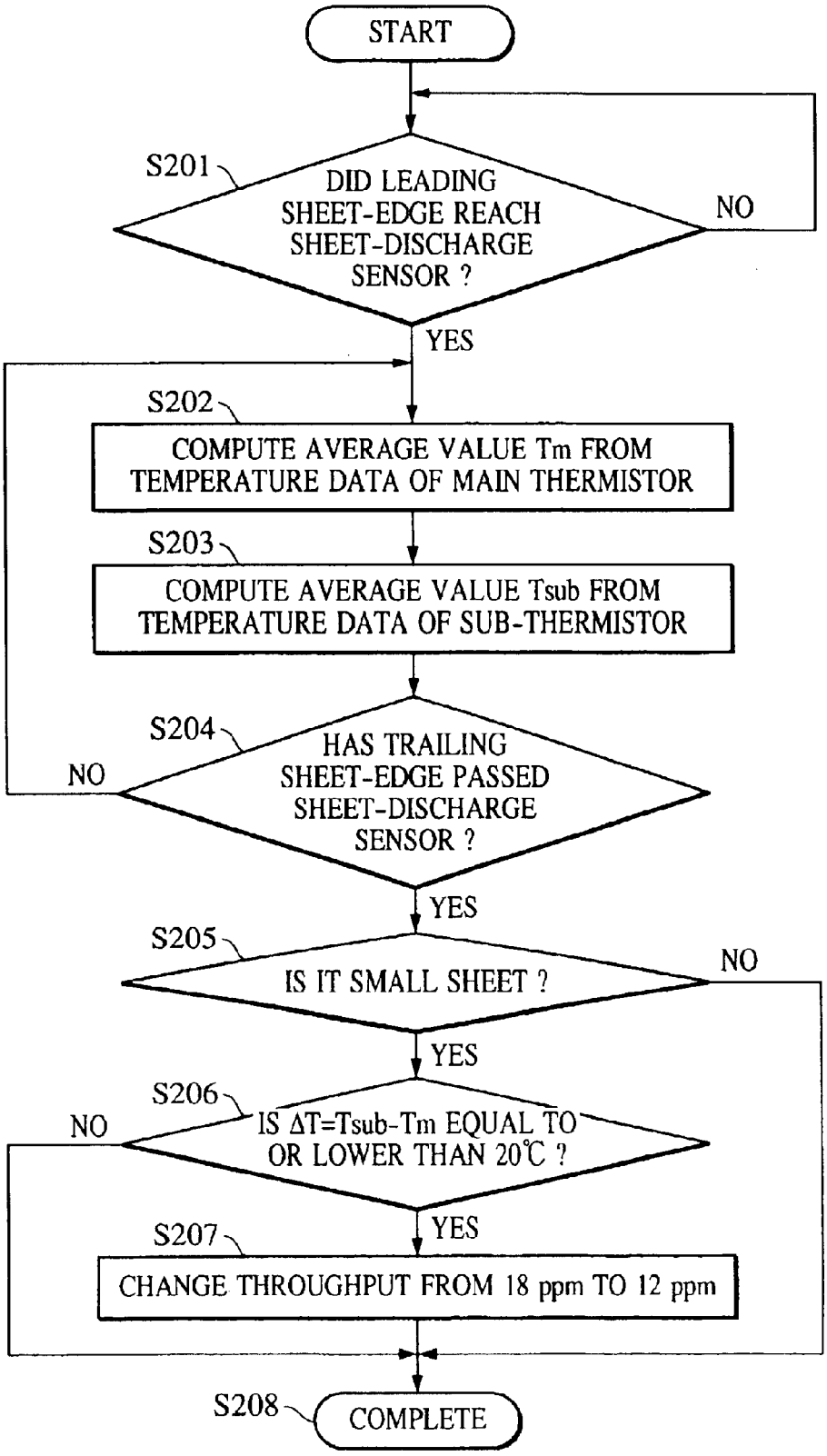
FIG. 2 is a flowchart of an operation of an imaging apparatus according to a second embodiment of the present invention.

FIG. 2 is a flowchart of an operation of the imaging apparatus according to the second embodiment.

As shown in FIG. 2, the computation of an average value Tm of the temperature measured by the main thermistor 11*d* (step 202) and an average value Tsub of the temperature measured by the sub-thermistor 11*e* (step 203) is repeatedly performed after the leading edge of a sheet reaches a sheet-discharge sensor (step 201) until the trailing edge of the sheet passes by the sheet-discharge sensor (step 204).

When it is determined that the sheet has a small size in step 205 as a result of measuring the length of the sheet by the sheet-discharge sensor, the process proceeds to step 206 in which it is determined whether or not the difference between the average value of the temperature measured by the sub-thermistor 11*e* and the average value of the temperature measured by the main thermistor 11*d* ($\Delta T = Tsub - Tm$) is less than or equal to 20° C. When the difference between the two average values of, temperature is less than or equal to 20° C., it is determined that a small sheet such as an envelope was supplied without being correctly set by using a side-restricting tray, and the throughput is changed from 18 ppm which is a throughput of printing regular-size sheets to 12 ppm which is a throughput of printing small sheets such as envelopes (step 207).

With this arrangement, the fuser can be protected from being damaged because the temperature in the end portions is kept from rising by appropriately reducing throughput, even when a thick sheet having a small width passes both by the main thermistor 11*d* and by the sub-thermistor 11*e* and the temperature in the end portion opposite to that provided with the sub-thermistor 11*e* rises, in such a case as the thick sheet having a small width such as an envelope is incorrectly set onto the side-restricting tray.

When it is determined in step 205 that the sheet is not a small sheet, the process proceeds to step 208 and is completed.

The side-restricting tray is considered to have been correctly set when it is determined that the difference of temperature exceeds 20° C. in step 206, and the process proceeds to step 208 and is completed.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. An image forming apparatus comprising:

an image forming unit for forming an image on a sheet of at least two different sizes;

a fuser for fixing the image over which the sheet with the image passes;

a first temperature-measuring device disposed at a substantially center position in a longitudinal direction of the fuser;

a second temperature-measuring device disposed at a non-center position in a longitudinal direction of the fuser; and a sheet conveying interval control for making the sheet conveying interval longer in a case that temperatures detected by said first and said second temperature-measuring devices represents that a temperature rise in end portions of said fuser occurs when a plurality of small size of sheets successively pass over said fuser, wherein, when a plurality of small size sheets successively pass over said fuser, even if temperatures detected by said first and said second temperature-measuring devices represents that substantially no temperature rise in end portion(s) of said fuser occurs, said sheet conveying interval control makes the sheet conveying interval longer.

2. An image forming apparatus according to claim 1, wherein said fuser is a film-heat-type fuser.

3. An image forming apparatus according to claim 1, wherein said sheet conveying interval control makes the sheet conveying interval longer even if a difference between temperatures respectively detected by said first and said second temperature-measuring devices is small, when the small size of sheets are incorrectly set.

4. An imaging apparatus comprising:

an image forming unit for forming an image on a sheet;

a fuser for fixing the image formed on the sheet;

a first temperature-measuring device disposed at a first position on the fuser;

a second temperature-measuring device disposed at a second position on the fuser; and a sheet conveying interval control for controlling a throughput of the imaging apparatus by controlling a sheet conveying interval, wherein, when a plurality of small size sheets successively pass over said fuser, even if temperatures detected by said first and said second temperature-measuring devices represent that substantially no temperature rise in end portion(s) of said fuser occurs, said sheet conveying interval control makes the sheet conveying interval longer.

5. An imaging apparatus according to claim 4, wherein said sheet conveying interval control reduces the throughput, when a plurality of small size sheets successively pass over said fuser and the difference between an average value of the temperature measured in a predetermined period by the first temperature-measuring device and another average value of the temperature measured in the predetermined period by the second temperature-measuring device is less than or equal to a predetermined value, or when a plurality of small size sheets successively pass over said fuser and the difference between the temperature measured by the first temperature-measuring device and the temperature measured by the second temperature-measuring device is less than or equal to a predetermined value for a predetermined number of sheets being performed for fixing.

6. An imaging apparatus according to claim 4, wherein said sheet conveying interval control suspends heating and conveying of the sheet when a plurality of small size sheets successively pass over said fuser and the difference between the temperature measured by the first temperature-measuring device and the temperature measured by the second temperature-measuring device is less than or equal to a predetermined value.

7. An imaging apparatus according to claim 4, wherein said fuser is a film-heat-type fuser.

8. An imaging apparatus according to claim 4, further comprising a size determining unit for determining whether a sheet is the small size, and a side-restricting tray, wherein when the side-restricting tray is set incorrectly for the sheet of the small size, temperatures detected by said first and said second temperature-measuring devices represent that substantially no temperature rise in end portion(s) of said fuser may occur, even if a plurality of small size sheets successively pass over said fuser.

9. An imaging apparatus according to claim 8, wherein the small size of said sheet is an envelope size.

10. An imaging apparatus according to claim 8, wherein the side-restricting tray regulates the position of the sheet to be set thereon with respect to a widthwise-intermediate part of the side-restricting tray.

11. A method for operating an image forming apparatus comprising the steps of:

forming an image on a sheet;

fixing the image formed on the sheet;

detecting a temperature by a first temperature-measuring device disposed at a substantially center position in a longitudinal direction of the fuser;

detecting a temperature by a second temperature-measuring device disposed at a non-center position in a longitudinal direction of the fuser; and controlling a sheet conveying interval for making the sheet conveying interval longer in a case that a temperature rise in end portion(s) of said fuser occurs when a plurality of small size sheets successively pass over said fuser, wherein, when a plurality of small size sheets successively pass over said fuser, even if temperatures detected by said first and said second temperature-measuring devices represent that substantially no temperature rise in end portion(s) of said fuser occurs, said sheet conveying interval controlling step makes the sheet conveying interval longer.

12. A method for operating an image forming apparatus according to claim 11, wherein said fuser is a film-heat-type fuser.

13. A method of operating an image forming apparatus according to claim 11, wherein said sheet conveying interval control step makes the sheet conveying interval longer even if a difference between temperatures respectively detected by said first and said second temperature-measuring devices is small, when the small size sheets are incorrectly set.

14. A method for operating an imaging apparatus comprising the steps of:

forming an image on a sheet;

fixing the image formed on the sheet;

detecting a temperature by a first temperature-measuring device disposed at a first position on the fuser;

detecting a temperature by a second temperature-measuring device disposed at a second position on the fuser; and controlling a sheet conveying interval to control a throughput of the imaging apparatus, wherein, when a plurality of small size sheets successively pass over said fuser, even if temperatures detected by said first and said second temperature-measuring devices represent that substantially no temperature rise in end portion(s) of said fuser occurs, said sheet conveying interval controlling step makes the sheet conveying interval longer.

15. A method for operating an imaging apparatus according to claim 14, wherein said sheet conveying interval controlling step reduces the throughput when a plurality of small size sheets successively pass over said fuser and the difference between an average value of the temperature measured in a predetermined period by the first temperature-measuring device and another average value of the temperature measured in the predetermined period by the second temperature-measuring device is less than or equal to a predetermined value, or when a plurality of small size sheets successively pass over said fuser and the difference between the temperature measured by the first temperature-measuring device and the temperature measured by the second temperature-measuring device is less than or equal to a predetermined value for a predetermined number of sheets being conveyed for fixing.

16. A method for operating an imaging apparatus according to claim 14, wherein said sheet conveying interval controlling step suspends heating and conveying of the sheet when a plurality of small size sheets successively pass over said fuser and the difference between the temperature measured by the first temperature-measuring device and the temperature measured by the second temperature-measuring device is less than or equal to a predetermined value.

17. A method for operating an imaging apparatus according to claim 14, wherein said fuser is a film-heat-type fuser.

18. A method for operating an imaging apparatus according to claim 14, further comprising a step of determining whether a sheet is the small size, wherein when a side-restricting tray is set incorrectly for the sheet of the small size, temperatures detected by said first and said second temperature-measuring devices represent that substantially no temperature rise in end portion(s) of said fuser may occur, even if a plurality of small size of sheets successively pass over said fuser.

19. A method for operating an imaging apparatus, according to claim 18, wherein the smaller size of said sheet is an envelope size.

20. A method for operating an imaging apparatus, according to claim 18, wherein the side-restricting tray regulates the position of the sheet to be set thereon with respect to a widthwise-intermediate part of the side-restricting tray.

* * * * *

UNITED STATES PATENT AND TRADEMARK OFFICE

CERTIFICATE OF CORRECTION

PATENT NO. : 6,801,729 B2
DATED : October 5, 2004
INVENTOR(S) : Atsushi Wada et al.

It is certified that error appears in the above-identified patent and that said Letters Patent is hereby corrected as shown below:

Column 2,
Line 56, “symmetrical” should read -- symmetrically --.

Column 4,
Line 66, “is” should read -- in --.

Column 6,
Line 47, “both by” should read -- by both --.

Column 7,
Line 25, “of,” should read -- of --.

Signed and Sealed this

First Day of February, 2005

JON W. DUDAS
*Director of the United States Patent and Trademark Office*